US010954013B2

(12) United States Patent
Nowaczyk

(10) Patent No.: US 10,954,013 B2
(45) Date of Patent: Mar. 23, 2021

(54) SYSTEM AND METHOD FOR COOLING AND DISTRIBUTING A FLUSHING GAS TO A PACKAGING CONTAINER

(71) Applicant: David Nowaczyk, Naperville, IL (US)

(72) Inventor: David Nowaczyk, Naperville, IL (US)

( * ) Notice: Subject to any disclaimer, the term of this patent is extended or adjusted under 35 U.S.C. 154(b) by 0 days.

(21) Appl. No.: 16/400,034

(22) Filed: May 1, 2019

(65) Prior Publication Data

US 2019/0337655 A1 Nov. 7, 2019

Related U.S. Application Data

(60) Provisional application No. 62/665,043, filed on May 1, 2018.

(51) Int. Cl.
*B65B 31/04* (2006.01)

(52) U.S. Cl.
CPC ..... *B65B 31/041* (2013.01); *B65B 31/044* (2013.01); *B65B 31/045* (2013.01)

(58) Field of Classification Search
CPC ..... B65B 31/04; B65B 31/041; B65B 31/044; B65B 31/045
USPC ..... 53/432; 141/89, 92
See application file for complete search history.

(56) References Cited

U.S. PATENT DOCUMENTS 3,654,768 A * 4/1972 Inglis ..... F25B 9/04 62/5
4,039,275 A 8/1977 McGettrick
4,063,367 A * 12/1977 Talalay ..... F26B 3/04 34/410
4,140,159 A * 2/1979 Domke ..... B65B 31/041 141/129
4,359,361 A * 11/1982 Wright ..... B29C 65/227 156/497
4,588,000 A * 5/1986 Malin ..... B65B 31/006 137/1
4,787,547 A 11/1988 Hella et al.
4,997,664 A * 3/1991 Williams ..... B65B 31/021 426/316
5,007,232 A * 4/1991 Caudill ..... B65B 55/10 141/63
5,010,736 A * 4/1991 York ..... F25B 9/04 62/263
5,417,255 A 5/1995 Sanflippo et al.
5,911,249 A 6/1999 Sanflippo et al.
5,961,000 A 10/1999 Sanflippo et al.
7,263,836 B2 * 9/2007 Gunawardana ..... F25B 9/04 62/5

(Continued)

OTHER PUBLICATIONS

Linde Gas, "The Ultimate Combination for Freshness. MAPAX Modified Atmosphere Packaging", Promotional Information Brochure, Created Aug. 26, 2008 per PDF "Properties", Publication Date Is Unknown.

*Primary Examiner* — Timothy L Maust
(74) *Attorney, Agent, or Firm* — David A. Gottardo Attorney at Law

(57) ABSTRACT

This invention relates generally to the distribution of a flushing gas during a packaging process. More specifically, the invention relates to a system and method for cooling and distributing a flushing gas during such a process that utilizes the gas' lower temperature and increased density to both maintain the flushing gases' placement within a packaging container and displace any undesirable gases there-from.

20 Claims, 5 Drawing Sheets

(56) References Cited

U.S. PATENT DOCUMENTS

| | | | | |
|---|---|---|---|---|
| 7,313,901 | B2 * | 1/2008 | Kakita | B65B 31/045 53/403 |
| 7,908,829 | B2 * | 3/2011 | Ligon | B65B 3/02 53/511 |
| 8,341,924 | B2 * | 1/2013 | Lindblad | B65B 55/10 53/111 R |
| 8,616,010 | B2 * | 12/2013 | Bakos | F25B 9/04 62/5 |
| 10,151,515 | B2 * | 12/2018 | Chen | F25B 9/04 |
| 2006/0162290 | A1 | 6/2006 | Kakita et al. | |
| 2008/0209914 | A1 * | 9/2008 | De Wergifosse | F25B 9/04 62/5 |
| 2012/0279180 | A1 | 11/2012 | Crawford et al. | |
| 2014/0123599 | A1 | 5/2014 | Gustafsson et al. | |
| 2015/0307217 | A1 | 10/2015 | Fairbank et al. | |
| 2016/0216009 | A1 | 6/2016 | Chen et al. | |
| 2020/0086270 | A1 * | 3/2020 | Leachman | B03C 1/14 |

* cited by examiner

SYSTEM AND METHOD FOR COOLING AND DISTRIBUTING A FLUSHING GAS TO A PACKAGING CONTAINER

CROSS REFERENCE TO RELATED APPLICATIONS

This application claims priority to U.S. Provisional Patent Application Ser. No. 62/665,043 having a filing date of May 1, 2018.

TECHNICAL FIELD OF THE INVENTION

This invention relates generally to the distribution of a flushing gas during a packaging process. More specifically, the invention relates to a system and method for cooling and distributing a flushing gas during such a process that utilizes the gas' lower temperature and increased density to both maintain the flushing gases' placement within a packaging container and displace any undesirable gases therefrom.

BACKGROUND OF THE INVENTION

Various food products are packaged within containers such that the freshness of the product is controlled and maintained via a minimization of the product's exposure to undesirable, atmospheric gases. This is because undesirable, atmospheric gases, such as residual oxygen, typically do not inhibit the growth of mold or bacteria within the product, or inhibit the product's oxidation. For example, certain granular food products, such as ground coffee, are packaged and sealed within cans or similar containers preferably having the undesirable gases displaced there-from. Such gas displacement occurs during the packaging process whereas any undesirable gases located within the container prior to, during and after the product is placed therein, is displaced there-from by a more desirable flushing gas. Common flushing gases comprise carbon dioxide, for the inhibition of mold or bacterial growth, or nitrogen, for the inhibition of oxidation.

More specifically, prior to the placement of the product within the container, the upper open end of the container travels under a plenum that injects a high-velocity, turbulent flow of flushing gas into the container to force the undesirable gases out of it. During the placement of the product within the container, the upper open end of the container is located under a plenum located proximal to a chute depositing the product into the container, with the plenum injecting a flushing gas into the container, prior to and during the product filling operation, to force the undesirable gases out of the container. After the placement of the product within the container, the upper open end of the container having the product therein travels under a plenum that injects a low-velocity, laminar flow of flushing gas into the container to force the undesirable gases out of it without disturbing the product located therein.

During the forgoing operations, it is beneficial for the flushing gas to remain within the container to ensure that it continues to provide preservation benefits to the product. However, complications arise with maintaining the flushing gas within the container during each operation. For example, the movement of the can along a production line prior to and after product filling operations often causes the flushing gases to "wash out" of the container, thus depriving the product of the gas' preservation benefits. During product placement operations, the product itself, while filling the container, undesirably displaces the flushing gas from the container, again depriving the product of the gas' preservation benefits. Thus, what is needed is a system and method that prevents or minimizes the wash-out or displacement of flushing gases from a packing container. The present invention meets these needs and provides numerous other advantages over the prior art.

SUMMARY OF THE INVENTION

This invention relates generally to the distribution of a flushing gas during a packaging process. More specifically, the invention relates to a system and method for cooling and distributing a flushing gas during such a process that utilizes the gas' lower temperature and increased density to both maintain the flushing gas' placement within a packaging container and displace any undesirable gases there-from.

The system for cooling and distributing a flushing gas comprises a flushing gas source for providing the flushing gas, a flushing gas distribution means both in fluid communication with the flushing gas source and adapted to flush a packaging container with a cooled flushing gas provided by a cooling means, the cooling means both in temperature communication with the flushing gas and located upstream of the distribution means.

In a preferred embodiment, the flushing gas source comprises a pressurized gas supply tank for holding a preselected flushing gas. However, it is understood that the gas source may comprise a compressor, pump, generator or other source understood in the art as providing a pressurized gas. The flushing gas may comprise any gas or blend of gases understood in the art as exhibiting properties desirable for preserving or maintaining the freshness of the goods being placed within the container to be flushed.

Thus, in one embodiment, the flushing gas comprises carbon dioxide ($CO_2$) when it is desirable to prevent or inhibit the grown of microorganisms, such as certain molds and aerobic bacteria within the packaged goods. In another embodiment, the flushing gas comprises nitrogen ($N_2$) due to its inert qualities and its ability to prevent or inhibit an oxidation of the goods. However, it is understood that yet embodiments may utilize various combinations of these and/or other gases as well.

The cooling means may comprise any means for cooling a gas, to include common refrigeration cycles, evaporative, convective, conductive, or liquid cooling methods, or any other cooling means understood in the art. In a preferred embodiment, however, the cooling means comprises a compressed gas vortex tube. The vortex tube, also known as the Ranque-Hilsch vortex tube, accepts an injection of the pressurized flushing gas through an inlet and into an internal cyclonic chamber where the gas is accelerated to a high rate of rotation. The spinning gas thereafter separates into hot outer and cold inner spinning layers. An inverse conical nozzle located at one end of the tube allows only the cold inner layer of gas to air to exit the device there (i.e., the cooled gas outlet) while the hot outer layer of gas exits an opposite end as an "exhaust" gas (i.e. the exhaust gas outlet).

In one embodiment of the system, a vortex tube used in combination with one embodiment of the flushing gas distribution means and associated container. The vortex tube defines a compressed gas inlet in fluid communication with the flushing gas source and a cooled gas outlet in fluid communication with the distribution means. The flushing gas from the gas source enters the compressed gas inlet of the vortex tube while the cooled flushing gas leaves the cooled gas outlet of the vortex tube and flows into the flushing gas distribution means. The distribution means, located above and proximal to an open upper end of the container, distributes the cold flushing gas into the container's interior prior to and/or during a filling of the container with a product.

The cooled flushing gas, having a density greater than that of the undesirable ambient air already present within the container, "settles" to the bottom of the container and accumulates upwardly to force the warmer and less dense ambient air up and out of the container through the container's open upper end. The cooled flushing gas, having properties favorable to maintaining a freshness of the product to be placed within the container, thus remains within the container awaiting and/or during product filling operations. In one embodiment, the vortex tube cools the cooled flushing gas to about twenty degrees Fahrenheit (20 deg. F.) below ambient or room temperature. However, it is understood that various other cooled gas temperatures may be utilized; depending upon ambient conditions, type of product packaged, and desired outcomes.

The exhaust gas outlet defined by the vortex tube is in fluid communication with the flushing gas source such that the exhaust gas, namely, warm, unused flushing gas is "recycled" for subsequent use by the system. In the preferred embodiment, the exhaust gas outlet of the vortex tube is in fluid communication with a product infill pathway such that exhaust flushing gas is recycled to mix with the product located therein. The product infill pathway is in product flow communication with the packaging container such that the pathway is utilized to fill the container with the product infused with recycled flushing gas. Granular product and recycled flushing gas flow downwardly through the pathway, from a product fill head of the system, and into the container having the cooled flushing gas located therein.

In yet another embodiment, the exhaust gas outlet of the vortex tube is in fluid communication with the product fill head itself such that exhaust flushing gas is recycled to maintain a positive pressure within the fill head and mix with the product located therein. This positive pressure aids in feeding the product from the fill head into and through the infill pathway during filling procedures. Regardless of the destination of any recycled exhaust gas, a heat sink may be utilized to reduce exhaust gas' temperature prior to the gas being recycled within the system. It is understood, however, that the vortex tube's exhaust gas outlet may simply exhaust the gas to the atmosphere without the system recycling it in any way. It is further understood that the vortex can operate without heated exhaust. This is done by adjusting the gas flow, inlet pressure and size of the output temperature and flow rate. Similarly, a control of the exhaust may be utilized to adjust the properties of the cooled gas. For example, a control valve in the hot air exhaust adjusts temperatures, flows and refrigeration over a wide range.

DESCRIPTION OF THE EMBODIMENTS

This invention relates generally to the distribution of a flushing gas during a packaging process. More specifically, the invention relates to a system and method for cooling and distributing a flushing gas during such a process that utilizes the gas' lower temperature and increased density to both maintain the flushing gas' placement within a packaging container and displace any undesirable gases there-from.

Figure 1:
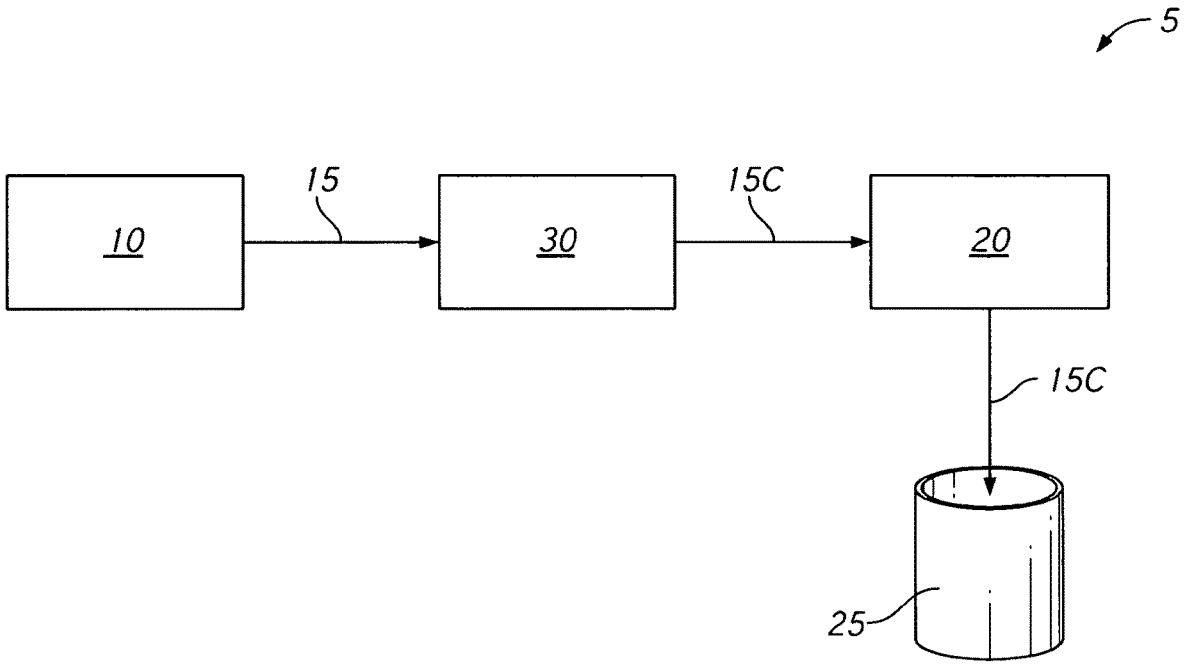
FIG. 1 is a schematic diagram illustrating the basic components of the system utilizing a cooling means.

FIG. 1 is a schematic diagram illustrating the basic components of the system 5. As illustrated in FIG. 1, the system 5 for cooling and distributing a flushing gas comprises a flushing gas source 10 for providing the flushing gas 15, a flushing gas distribution means 20 both in fluid communication with the flushing gas source and adapted to flush a packaging container 25 with a cooled flushing gas 15C provided by a cooling means 30, the cooling means both in temperature communication with the flushing gas and located upstream of the distribution means.

In a preferred embodiment, the flushing gas source 10 comprises a pressurized gas supply tank 35 (not shown) for holding a pre-selected flushing gas 15. However, it is understood that the gas source 10 may comprise a compressor, pump, generator or other source understood in the art as providing a pressurized gas. The flushing gas may comprise any gas or blend of gases understood in the art as exhibiting properties desirable for preserving or maintaining the freshness of the goods being placed within the container to be flushed.

Thus, in one embodiment, the flushing gas 15 comprises carbon dioxide ($CO_2$) when it is desirable to prevent or inhibit the growth of microorganisms, such as certain molds and aerobic bacteria within the packaged goods. In another embodiment, the flushing gas 15 comprises nitrogen ($N_2$) due to its inert qualities and its ability to prevent or inhibit an oxidation of the goods. However, it is understood that yet embodiments may utilize various combinations of these and/or other gases as well.

The cooling means 30 may comprise any means for cooling a gas, to include common refrigeration cycles, evaporative, convective, conductive, or liquid cooling methods, or any other cooling means understood in the art. In a preferred embodiment, however, the cooling means 30 comprises a compressed gas vortex tube. The vortex tube, also known as the Ranque-Hilsch vortex tube, accepts an injection of the pressurized flushing gas through an inlet and into an internal cyclonic chamber where the gas is accelerated to a high rate of rotation. The spinning gas thereafter separates into hot outer and cold inner spinning layers. An inverse conical nozzle located at one end of the tube allows only the cold inner layer of gas to exit the device there (i.e., the cooled gas outlet) while the hot outer layer of gas exits an opposite end as an "exhaust" gas (i.e. the exhaust gas outlet).

Figure 2:
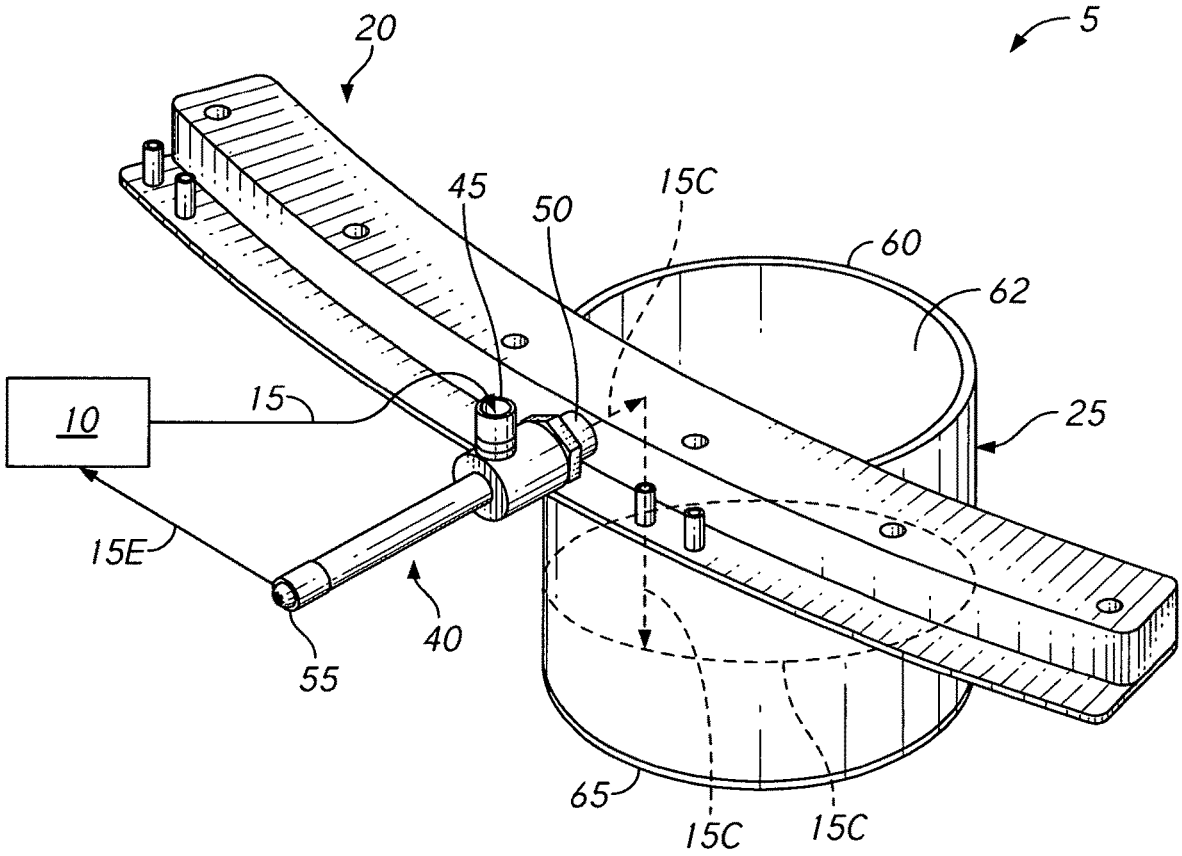
FIG. 2 is a perspective view of the system wherein the cooling means comprises a vortex tube and exhaust gas is recycled to the gas source.
Figure 3:
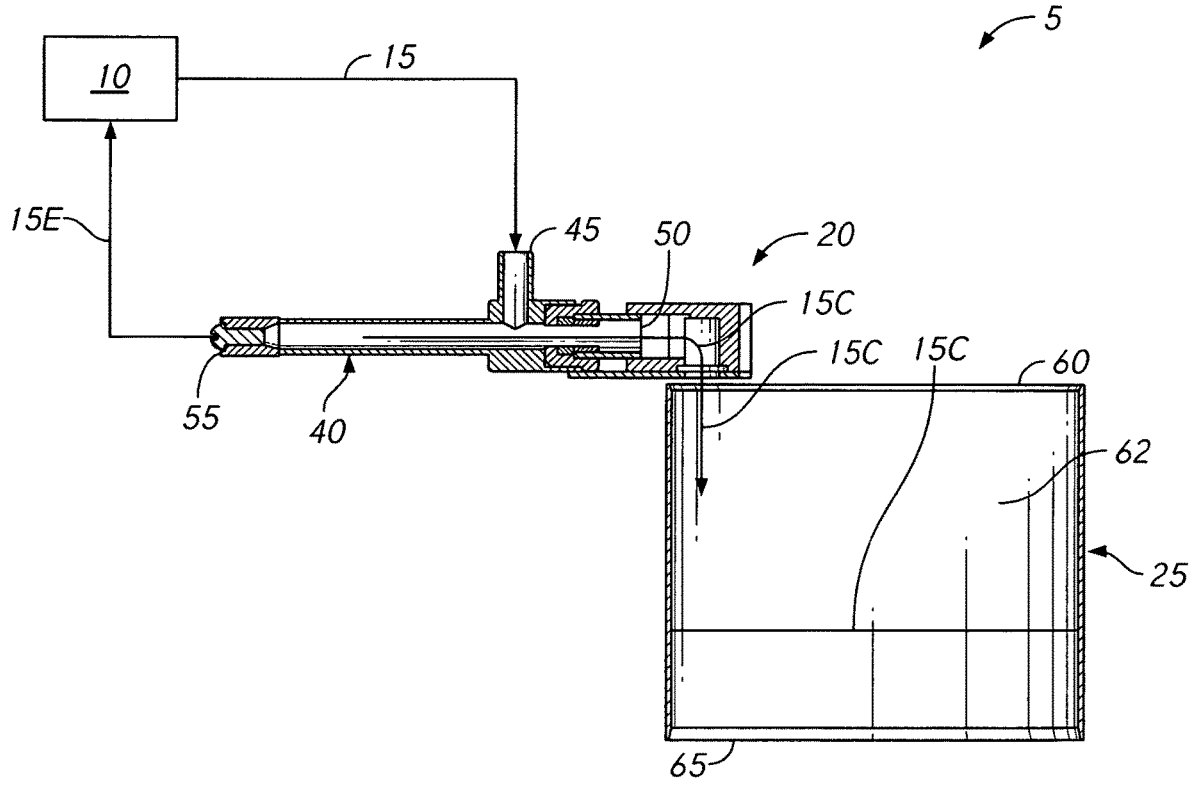
FIG. 3 is a sectional view of the system of FIG. 2.

FIGS. 2 and 3 illustrate one embodiment of the system 5 utilizing a vortex tube 40 used in combination with one embodiment of the flushing gas distribution means 20 and associated container 25. The vortex tube 40 defines a compressed gas inlet 45 in fluid communication with the flushing gas source 10 and a cooled gas outlet 50 in fluid communication with the distribution means 20. The flushing gas 15 from the gas source 10 enters the compressed gas inlet 45 of the vortex tube 40 while the cooled flushing gas 15C leaves the cooled gas outlet 50 of the vortex tube and flows into the flushing gas distribution means 20. The distribution means 20, located above and proximal to an open upper end 60 of the container 25, distributes the cold flushing gas 15 into the container's interior 62 prior to and/or during a filling of the container with a product (not shown).

The cooled flushing gas 15C, having a density greater than that of the undesirable ambient air already present within the container 25, "settles" to the bottom 65 of the container and accumulates upwardly to force the warmer and less dense ambient air up and out of the container through the container's open upper end 60. The cooled flushing gas 15C, having properties favorable to maintaining a freshness of the product to be placed within the container, thus remains within the container awaiting and/or during product filling operations. In one embodiment, the vortex tube cools the cooled flushing gas 15C to about twenty degrees Fahrenheit (20 deg. F.) below ambient or room temperature. However, it is understood that various other cooled gas temperatures may be utilized, depending upon ambient conditions, type of product packaged, and desired outcomes. It is further understood that the cooling means may be utilized with and thus cool flushing gas provided to various embodiments of the flushing gas distribution means other than that disclosed within this application. Thus, the claimed system 5 may utilize the plenum of U.S. Provisional Patent Application No. 62/665,022 and/or the gassing rail of U.S. Pat. No. 5,911,249 (each incorporated by reference herein).

Figure 4:
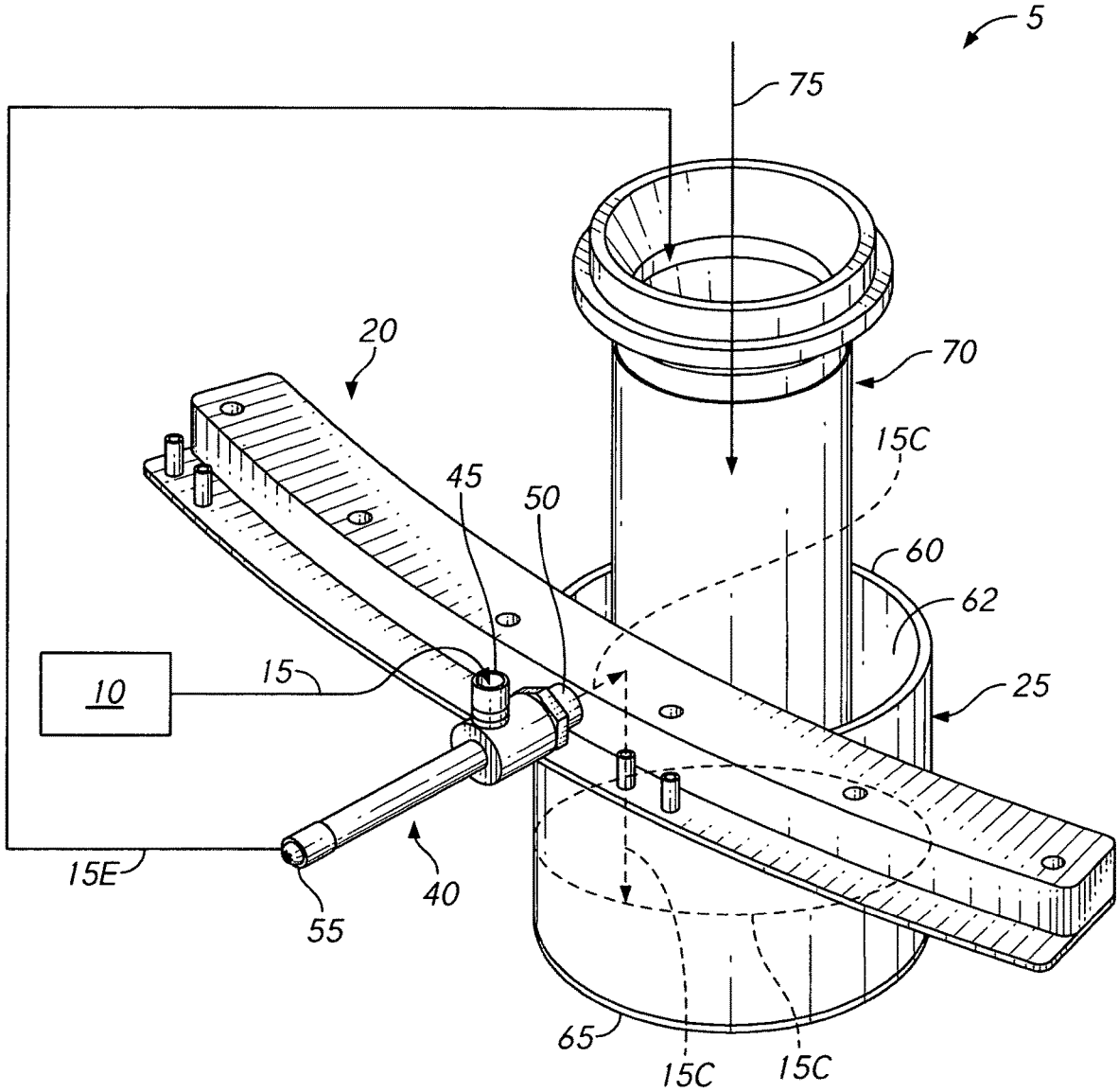
FIG. 4 is a perspective view of the system wherein the cooling means comprises a vortex tube and exhaust gas is recycled to a product infill pathway.
Figure 5:
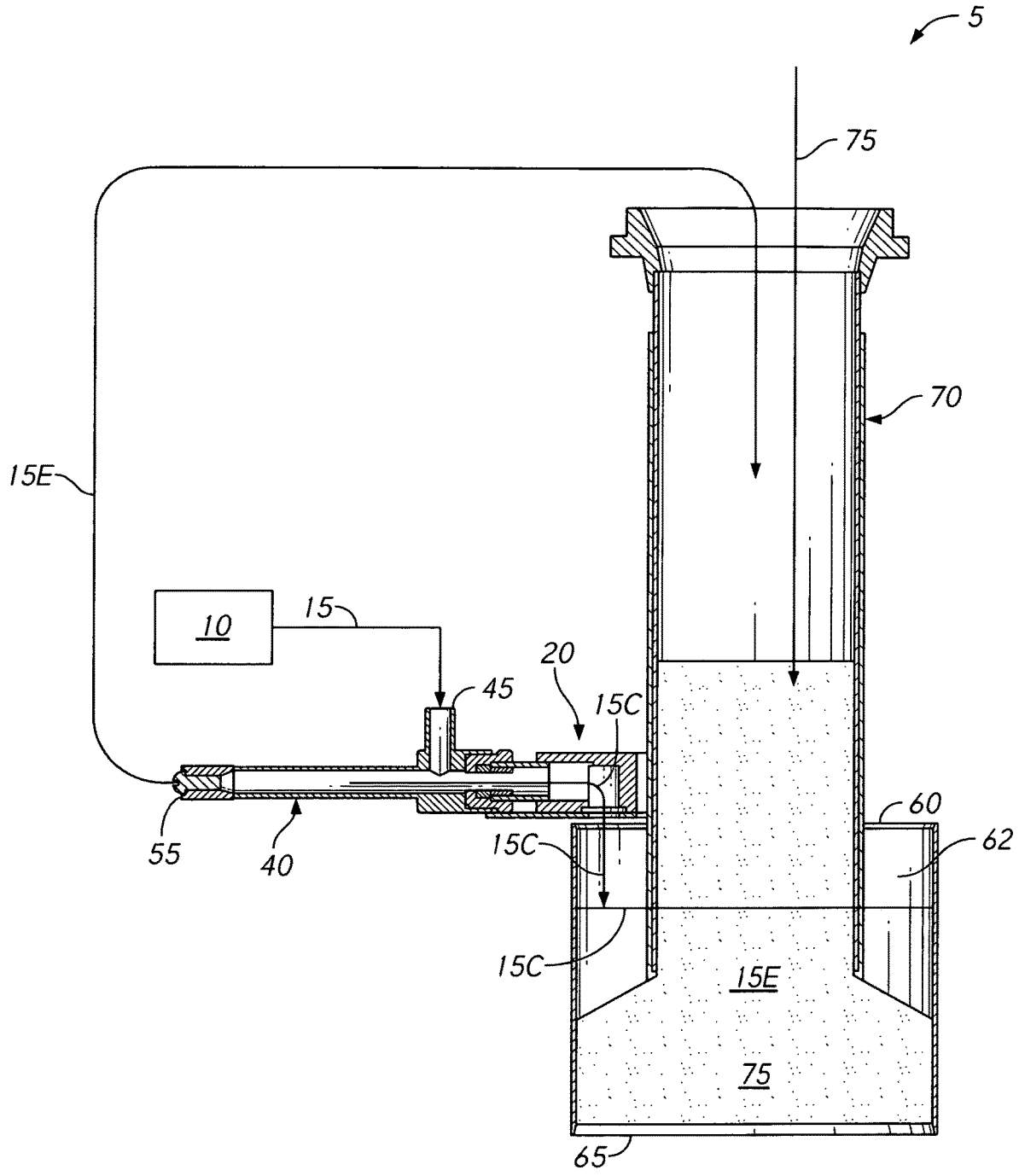
FIG. 5 is a sectional view of the system of FIG. 4.

Referring again to FIGS. 2 and 3, the exhaust gas outlet 55 defined by the vortex tube 40 is in fluid communication with the flushing gas source 10 such that the exhaust gas, namely, warm, unused flushing gas 15E, is "recycled" for subsequent use by the system 5. In the preferred embodiment illustrated in FIGS. 4 and 5, the exhaust gas outlet 55 of the vortex tube 40 is in fluid communication with a product infill pathway 70 such that exhaust flushing gas 15E is recycled to mix with the product 75 located therein. Product infill pathway 70 is in product flow communication with the packaging container 25 such that the pathway is utilized to fill the container with the product 75 infused with recycled flushing gas 15E (FIG. 5). As best illustrated in FIG. 5, granular product 75 and recycled flushing gas 15E flows downwardly through the pathway 70, from a product fill head (not shown) of the system 5, and into the container 25 having the cooled flushing gas 15C located therein.

In yet another embodiment (not shown), the exhaust gas outlet 55 of the vortex tube 40 is in fluid communication with the product fill head itself such that exhaust flushing gas 15E is recycled to maintain a positive pressure within the fill head and mix with the product 75 located therein. This positive pressure aids in feeding the product from the fill head into and through the infill pathway during filling procedures. Regardless of the destination of any recycled exhaust gas 15E, a heat sink (not shown) may be utilized to reduce the exhaust gas' temperature prior to the gas being recycled within the system. It is understood, however, that the vortex tube's exhaust gas outlet 55 may simply exhaust the gas 15E to the atmosphere without the system 5 recycling it in any way. It is further understood that the vortex can operate without heated exhaust. This is done by adjusting the gas flow, inlet pressure and size of the output temperature and flow rate. Similarly, a control of the exhaust may be utilized to adjust the properties of the cooled gas. For example, a control valve in the hot air exhaust adjusts temperatures, flows and refrigeration over a wide range.

In use, a system 5 is provided for cooling and distributing a flushing gas, the system comprising a flushing gas source 10 for providing the flushing gas 15, a flushing gas distribution means 20 both in fluid communication with the flushing gas source and adapted to flush a packaging container 25 with a cooled flushing gas 15C provided by a cooling means 30, the cooling means both in temperature communication with the flushing gas and located upstream of the distribution means. The flushing gas source 10 provides the flushing gas to the cooling means 30. The cooling means 30 cools the flushing gas 15 and provides the cooled flushing gas 15C to the flushing gas distribution means 20 located proximal the packaging container 25, with the packaging container containing at least an undesirable gas within an interior 62 of the container. The flushing gas distribution 20 means distributes the cooled flushing gas 15C to the interior 62 of the container 25, the flushing gas preferably settling to a bottom 65 of the container's interior and accumulating to displace the undesirable gas therefrom and out of the container's open upper end 60.

In embodiments of the system wherein the cooling means comprises a vortex tube 40, the flushing gas source 10 provides the flushing gas to the inlet 45 of the vortex tube. The vortex tube 40 cools the flushing gas 15 and provides the cooled flushing gas 15C form the tube's cooled gas outlet 50 to the flushing gas distribution means 20 located proximal the packaging container 25, with the packaging container containing at least an undesirable gas within an interior 62 of the container. The flushing gas distribution 20 means distributes the cooled flushing gas 15C to the interior 62 of the container 25, the flushing gas preferably settling to a bottom 65 of the container's interior and accumulating to displace the undesirable gas therefrom and out of the container's open upper end 60.

In one embodiment, the exhaust gas outlet 55 of the vortex tube 40 provides exhaust flushing gas 15E to a product infill pathway 70 such that exhaust flushing gas 15E is recycled to mix with the product 75 located therein. In another embodiment, the exhaust gas outlet 55 of the vortex tube 40 provides exhaust flushing gas 15E to a product fill head such that exhaust flushing gas 15E is recycled to maintain a positive pressure within the fill head and mix with the product 75 located therein.

While this foregoing description and accompanying figures are illustrative of the present invention, other variations in structure and method are possible without departing from the invention's spirit and scope.

I claim:

1. A system for cooling and distributing a flushing gas to a packaging container comprising:

a flushing gas source for providing the flushing gas;

a flushing gas distribution means in fluid communication with the flushing gas source, the distribution means adapted to flush the packaging container with the flushing gas, the distribution means located above and proximal to an open end of the packaging container; and a vortex tube defining a compressed gas inlet in fluid communication with the flushing gas source and a cooled gas outlet in fluid communication with the distribution means, the vortex tube further defining an exhaust gas outlet, the vortex tube directing a cooled flushing gas from the cooled gas outlet to the distribution means.

2. The system of claim 1 wherein the exhaust gas outlet of the vortex tube is in fluid communication with the flushing gas source and directs an exhaust gas thereto.

3. The system of claim 2 further comprising a heat sink operably associated with the exhaust gas, the heat sink cooling the exhaust gas directed to the flushing gas source.

4. The system of claim 1 wherein the cooled flushing gas has a temperature of about twenty degrees Fahrenheit below an ambient temperature.

5. The system of claim 1 wherein the flushing gas is nitrogen.

6. The system of claim 1 wherein the flushing gas is carbon dioxide.

7. A system for cooling and distributing a flushing gas to a packaging container comprising:

a flushing gas source for providing the flushing gas;

a flushing gas distribution means in fluid communication with the flushing gas source, the distribution means adapted to flush the packaging container with the flushing gas;

a vortex tube defining a compressed gas inlet in fluid communication with the flushing gas source and a cooled gas outlet in fluid communication with the distribution means, the vortex tube further defining an exhaust gas outlet, the vortex tube directing a cooled flushing gas from the cooled gas outlet to the distribution means; and a product fill head in product flow communication with the packaging container, the exhaust gas outlet of the vortex tube in fluid communication with the product fill head and directing an exhaust gas thereto.

8. The system of claim 7 further comprising a heat sink operably associated with the exhaust gas, the heat sink cooling the exhaust gas directed to the product fill head.

9. A system for cooling and distributing a flushing gas to a packaging container comprising:

a flushing gas source for providing the flushing gas;

a flushing gas distribution means in fluid communication with the flushing gas source, the distribution means adapted to flush the packaging container with the flushing gas;

a vortex tube defining a compressed gas inlet in fluid communication with the flushing gas source and a cooled gas outlet in fluid communication with the distribution means, the vortex tube further defining an exhaust gas outlet, the vortex tube directing a cooled flushing gas from the cooled gas outlet to the distribution means; and a product infill pathway in product flow communication with the packaging container, the exhaust gas outlet of the vortex tube in fluid communication with the product infill pathway and directing an exhaust gas thereto.

10. The system of claim 9 further comprising a heat sink operably associated with the exhaust gas, the heat sink cooling the exhaust gas directed to the product infill pathway.

11. A method for cooling and distributing a flushing gas to a packaging container comprising:

providing the flushing gas pressurized from a flushing gas source, a vortex tube for cooling the flushing gas, and a gas distribution mean for distributing the flushing gas to the packaging container, the vortex tube defining a compressed gas inlet in fluid communication with the flushing gas source and a cooled gas outlet in fluid communication with the distribution means, the vortex tube further defining an exhaust gas outlet;

moving the flushing gas from the flushing gas source to the compressed gas inlet of the vortex tube, the vortex tube producing a cooled flushing gas;

moving the cooled flushing gas from the cooled gas outlet of the vortex tube to the gas distribution means located above and proximal to an open end of the packaging container; and distributing the cooled flushing gas to an interior of the container, the flushing gas settling to a bottom of the container's interior and accumulating therein.

12. The method of claim 11 further comprising moving an exhaust gas from the exhaust gas outlet of the vortex tube to the flushing gas source.

13. The method of claim 12 further comprising providing a heat sink operably associated with the exhaust gas to produce a cooled exhaust gas and moving the cooled exhaust gas from the heat sink to the flushing gas source.

14. The method of claim 11 wherein the cooled flushing gas has a temperature of about twenty degrees Fahrenheit below an ambient temperature.

15. The method of claim 11 wherein the flushing gas is nitrogen.

16. The method of claim 11 wherein the flushing gas is carbon dioxide.

17. A method for cooling and distributing a flushing gas to a packaging container comprising:

providing the flushing gas pressurized from a flushing gas source, a vortex tube for cooling the flushing gas, and a gas distribution mean for distributing the flushing gas to the packaging container, the vortex tube defining a compressed gas inlet in fluid communication with the flushing gas source and a cooled gas outlet in fluid communication with the distribution means, the vortex tube further defining an exhaust gas outlet;

moving the flushing gas from the flushing gas source to the compressed gas inlet of the vortex tube, the vortex tube producing a cooled flushing gas;

moving the cooled flushing gas from the cooled gas outlet of the vortex tube to the gas distribution means located proximal to the packaging container;

distributing the cooled flushing gas to an interior of the container, the flushing gas settling to a bottom of the container's interior and accumulating therein; and providing a product fill head in product flow communication with the packaging container and moving an exhaust gas from the exhaust gas outlet of the vortex tube to the product fill head.

18. The method of claim 17 further comprising providing a heat sink operably associated with the exhaust gas to produce a cooled exhaust gas and moving the cooled exhaust gas from the heat sink to the product fill head.

19. A method for cooling and distributing a flushing gas to a packaging container comprising:

providing the flushing gas pressurized from a flushing gas source, a vortex tube for cooling the flushing gas, and a gas distribution mean for distributing the flushing gas to the packaging container, the vortex tube defining a compressed gas inlet in fluid communication with the flushing gas source and a cooled gas outlet in fluid communication with the distribution means, the vortex tube further defining an exhaust gas outlet;

moving the flushing gas from the flushing gas source to the compressed gas inlet of the vortex tube, the vortex tube producing a cooled flushing gas;

moving the cooled flushing gas from the cooled gas outlet of the vortex tube to the gas distribution means located proximal to the packaging container;

distributing the cooled flushing gas to an interior of the container, the flushing gas settling to a bottom of the container's interior and accumulating therein; and providing a product infill pathway in product flow communication with the packaging container and moving an exhaust gas from the exhaust gas outlet of the vortex tube to the product infill pathway.

20. The method of claim 19 further comprising providing a heat sink operably associated with the exhaust gas to produce a cooled exhaust gas and moving the cooled exhaust gas from the heat sink to the product infill pathway.

* * * * *